US006966781B1

(12) United States Patent
Bullinger et al.

(10) Patent No.: US 6,966,781 B1
(45) Date of Patent: Nov. 22, 2005

(54) ELECTROMECHANICAL CONNECTOR

(75) Inventors: Achim Bullinger, Kirchstrasse 14, D-89551 Koenigsbronn-Zang (DE); Klaus-Dieter Fritsch, Heidenheim (DE); Hermann Neidlein, Heidenheim (DE)

(73) Assignee: Achim Bullinger, Koeningsbronn-Zang (DE)

( * ) Notice: Subject to any disclaimer, the term of this patent is extended or adjusted under 35 U.S.C. 154(b) by 0 days.

(21) Appl. No.: 09/214,034

(22) PCT Filed: Jun. 21, 1997

(86) PCT No.: PCT/EP97/03262

§ 371 (c)(1),
(2), (4) Date: Jun. 17, 1999

(87) PCT Pub. No.: WO97/50152

PCT Pub. Date: Dec. 31, 1997

(30) Foreign Application Priority Data

Jun. 22, 1996 (DE) ..... 296 10 996

(51) Int. Cl.[7] ..... H01R 13/60; H01R 25/00
(52) U.S. Cl. ..... 439/38; 439/289
(58) Field of Search ..... 439/38, 188, 289, 439/200, 137, 146; 335/177, 179, 205–208; 200/11 R–11 TW, 51 R–51.07, 303

(56) References Cited

U.S. PATENT DOCUMENTS 2,573,920 A * 11/1951 McLeod ..... 200/51.09 X
3,261,944 A * 7/1966 Sherwood ..... 335/78
3,521,216 A * 7/1970 Tolegian ..... 439/39
4,004,298 A * 1/1977 Freed ..... 439/38
4,317,969 A * 3/1982 Riegler et al. ..... 200/52 R
4,647,120 A * 3/1987 Karabakakis ..... 439/39
4,719,334 A * 1/1988 Rebel ..... 200/51.09 X
5,829,987 A * 11/1998 Fritsch et al. ..... 439/38
5,921,783 A * 7/1999 Fritsch et al. ..... 439/38

FOREIGN PATENT DOCUMENTS

| | | |
|---|---|---|
| CH | 681121 | 1/1993 |
| DE | 2643031 | 3/1978 |
| DE | 29516069 | 2/1996 |
| WO | WO92/16002 | 9/1992 |

* cited by examiner

*Primary Examiner*—Neil Abrams
(74) *Attorney, Agent, or Firm*—Barnes & Thornburg

(57) ABSTRACT

The electromechanical connector proposed has a switch and an actuator. The switch can be connected by means of contacts to a power supply and has switching magnets with encoded magnetic elements mounted on a carriage. It is fitted in a housing as an enclosed unit. The actuator has actuation magnets with encoded magnetic elements and can be connected to a consumer. The switch can be connected to the actuator, connecting these two devices causing the switching magnets to move, against a restraining force, from an inoperative position to an operating position. The electrical connection between the switch and the actuator is thus established by means of contacts. The ends of the switch and actuator facing each other are fitted with alignment devices designed so that electrical contact between the switch and the actuator can only be made when the contacts are in a particular position with respect to each other.

10 Claims, 6 Drawing Sheets

ELECTROMECHANICAL CONNECTOR

CROSS-REFERENCES TO RELATED APPLICATIONS

Figure 1:
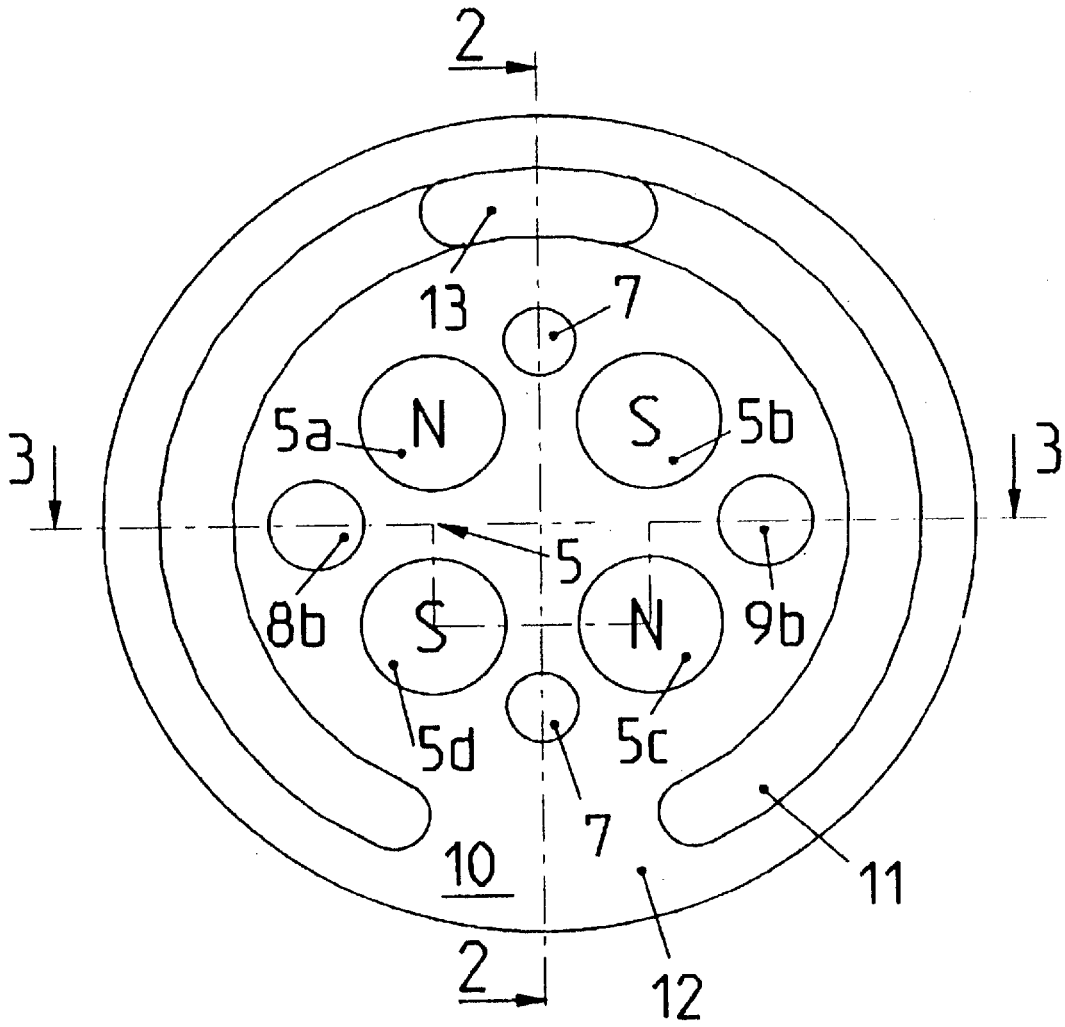

Not applicable.

STATEMENT REGARDING FEDERALLY SPONSORED RESEARCH & DEVELOPMENT

Not applicable.

BACKGROUND OF THE INVENTION

The invention relates to an electromechanical connecting device according to the type defined in more detail in the preamble of claim 1.

DESCRIPTION OF THE RELATED ART INCLUDING INFORMATION DISCLOSED UNDER 37 CFR 1.97 & 1.98.

A connecting device of this type is described in EP 0 573 471 B1. This already known connecting device, which comprises a switching mechanism which takes over the function of a socket-outlet of conventional type, and a tripping mechanism which takes over the function of a plug connected to a consumer, provides a connecting device which has a very shallow overall depth and which, in addition, satisfies stringent safety requirements.

In this connecting device, the mechanical and the electric contacts are made via coded magnets, coded magnets signifying that each magnet is assembled from magnet parts with different polarities. An electric connection between the switching mechanism and the tripping mechanism is made only when the coded magnet parts of the switching mechanism cooperate with the correspondingly coded tripping magnet parts of the tripping mechanism. It is only this cooperation which brings the operating slide of the switching mechanism into a position such that the current passes from contact elements of the switching mechanism to contact elements of the tripping mechanism. Again, it is also disadvantageous that the electric contact also takes place via the coded magnets.

It is the object of the present invention to achieve a further improvement in the electromechanical connecting device mentioned at the beginning, in particular a further increase in the safety and/or avoidance of maloperations which can lead to short circuits.

BRIEF SUMMARY OF THE INVENTION

According to the invention, this object is achieved by means of providing a switching mechanism and a tripping mechanism which are provided with mutually facing end faces with centering elements such that the electrical connection between the switching mechanism and tripping mechanism can only be made in a specific postion of the contact elements or parts relative to one another.

The centering elements according to the invention ensure that it is only in a specific position and a specific position of the contact elements that the switching mechanism and the tripping mechanism can be brought into a relationship with one another in such a way that current flows. This means that the contact elements or contact poles cannot be reversed. This measure is suitable, in particular, in the case of use of the electromechanical connecting device for the field of direct current, and in particular in this case for the low-voltage range for controllers, computers and the like, since it is impermissible in this case for there to be any confusion between positive and negative poles. Otherwise there would be short circuits and associated destruction of components.

A simple configuration of the centering elements can consist in that the latter are provided at least with a projection in the end face of one part, it being possible, in addition, for there to be present an elevation which rises above the projection and which is assigned a correspondingly adapted depression or additional trough in the end face of the other mechanism.

Projections and depressions required for the said purpose can be relatively flat and therefore do not lead to an increase in the overall size, or do so only negligibly.

A very advantageous development of the centering elements can consist in that the mechanism is constructed as a bulging partial annular bead which is arranged in the outer region of the end face and, when the electric connection is made, is situated in a partial annular groove adapted with reference to shape and position, in the other mechanism.

The elevation has the effect that very fast and precise separation occurs during disengagement, which is generally performed by a slight rotation of the switching mechanism and tripping mechanism relative to one another, with the result that the current is likewise interrupted very quickly and precisely.

A simple solution which aids rotation during detachment of the switching mechanism from the tripping mechanism can consist in that the partial annular bead is provided with the elevation and in that the trough is formed in the partial annular groove.

In this configuration, it is possible in a simple way to provide the partial annular bead with the elevation and to form the trough correspondingly in the partial annular groove.

The contact elements in the switching mechanism and the tripping mechanism are advantageously separated from the coded magnets.

BRIEF DESCRIPTION OF THE SEVERAL VIEW OF THE DRAWINGS

Figure 2:
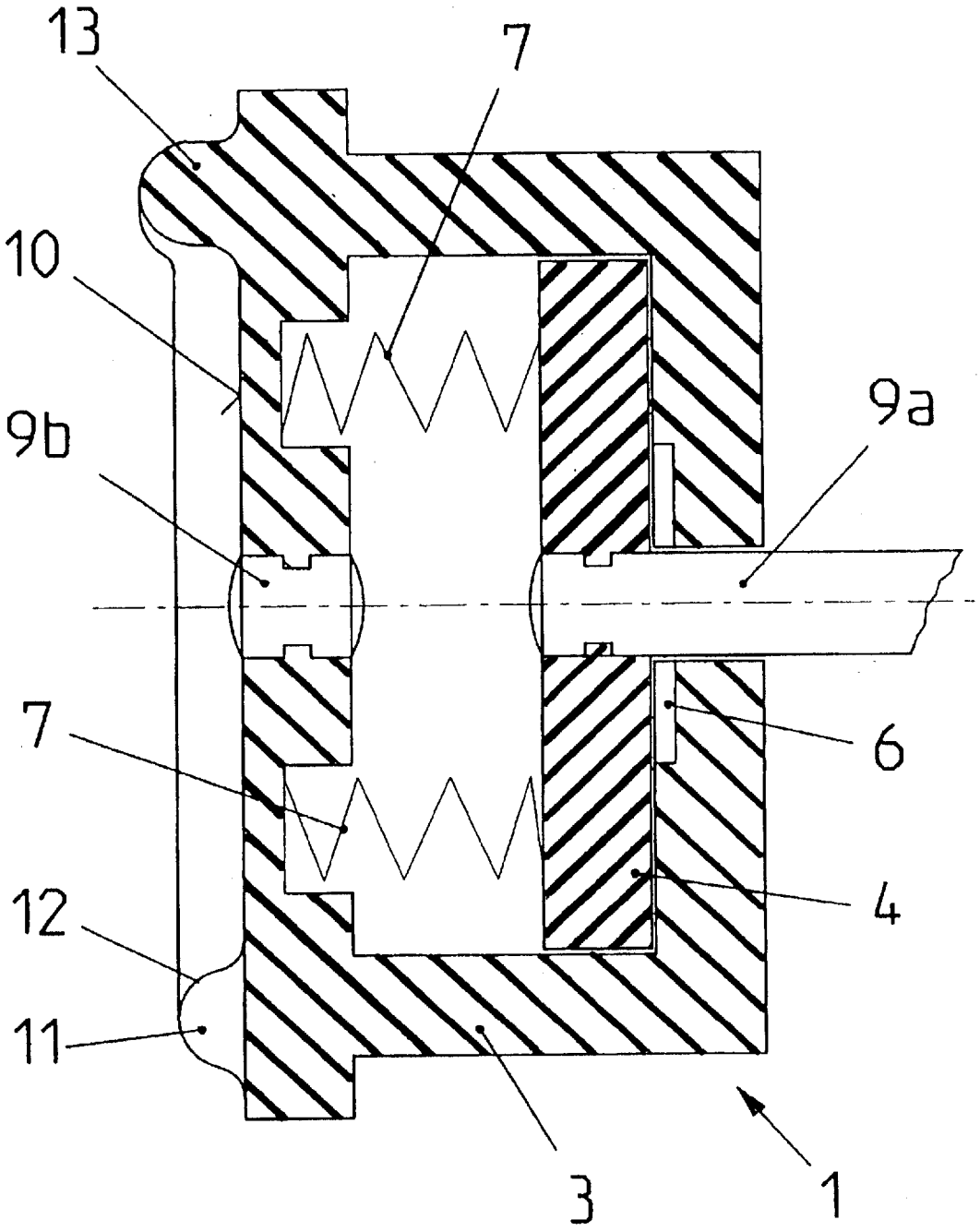
Figure 3:
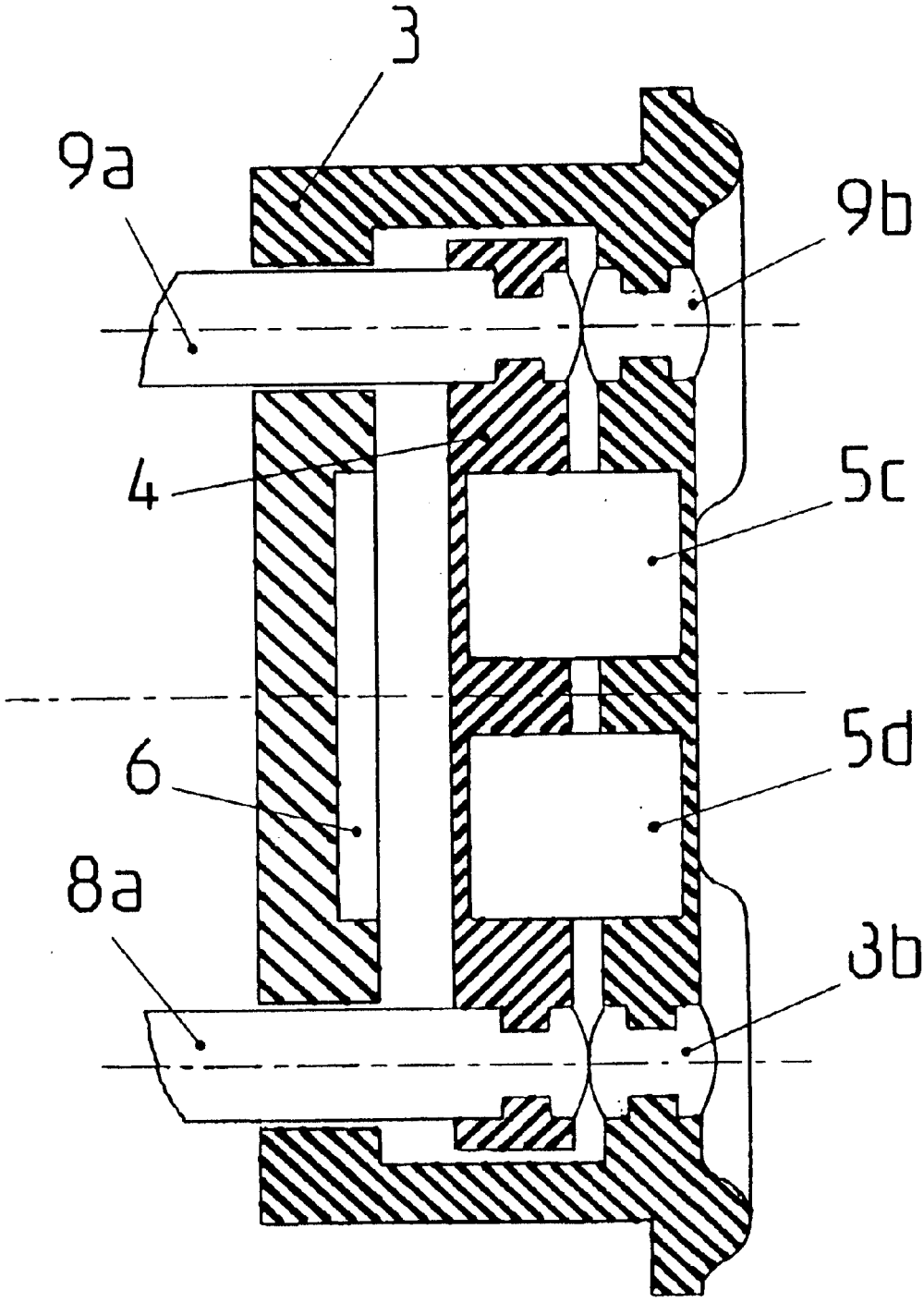
Figure 4:
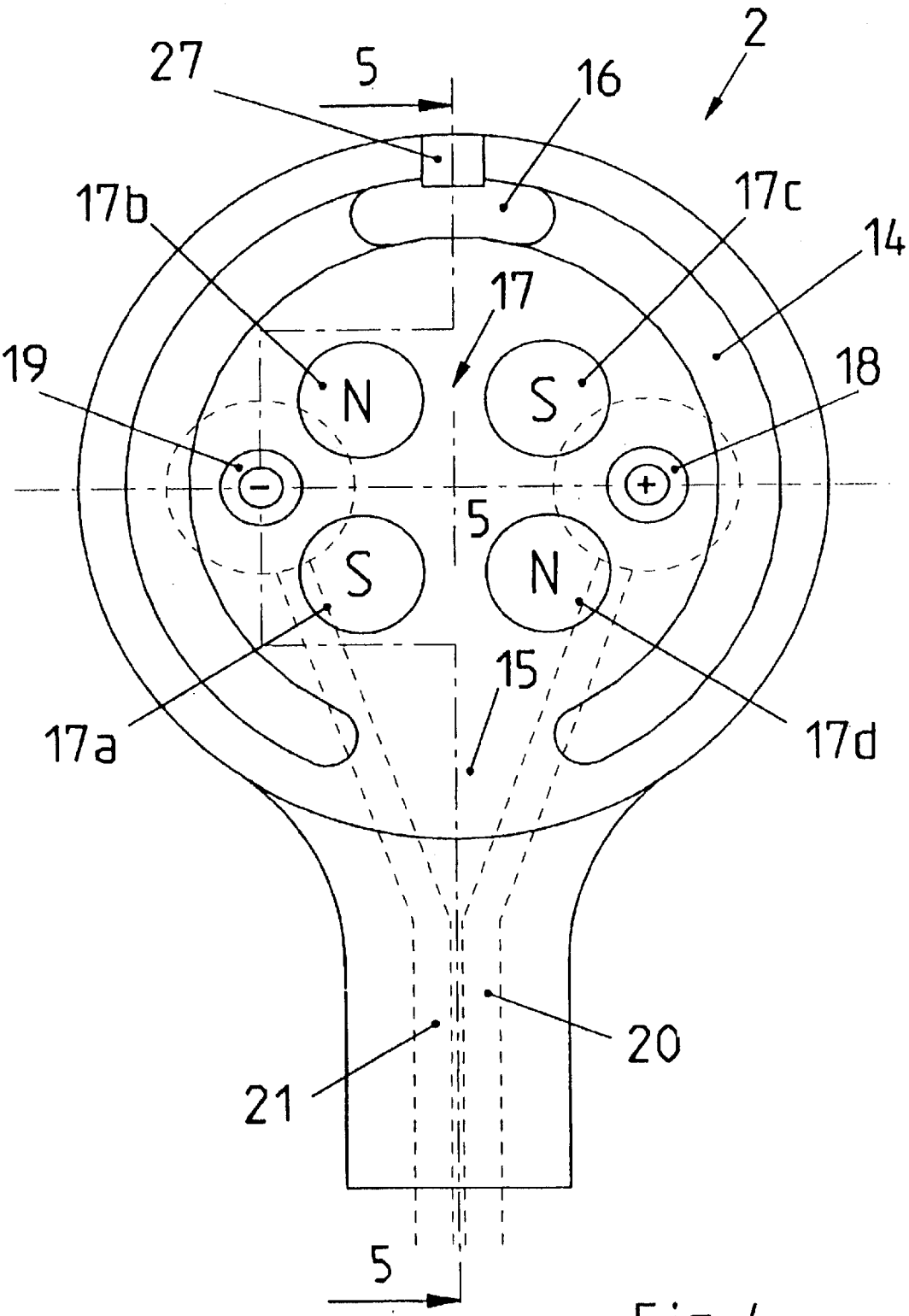
Figure 5:
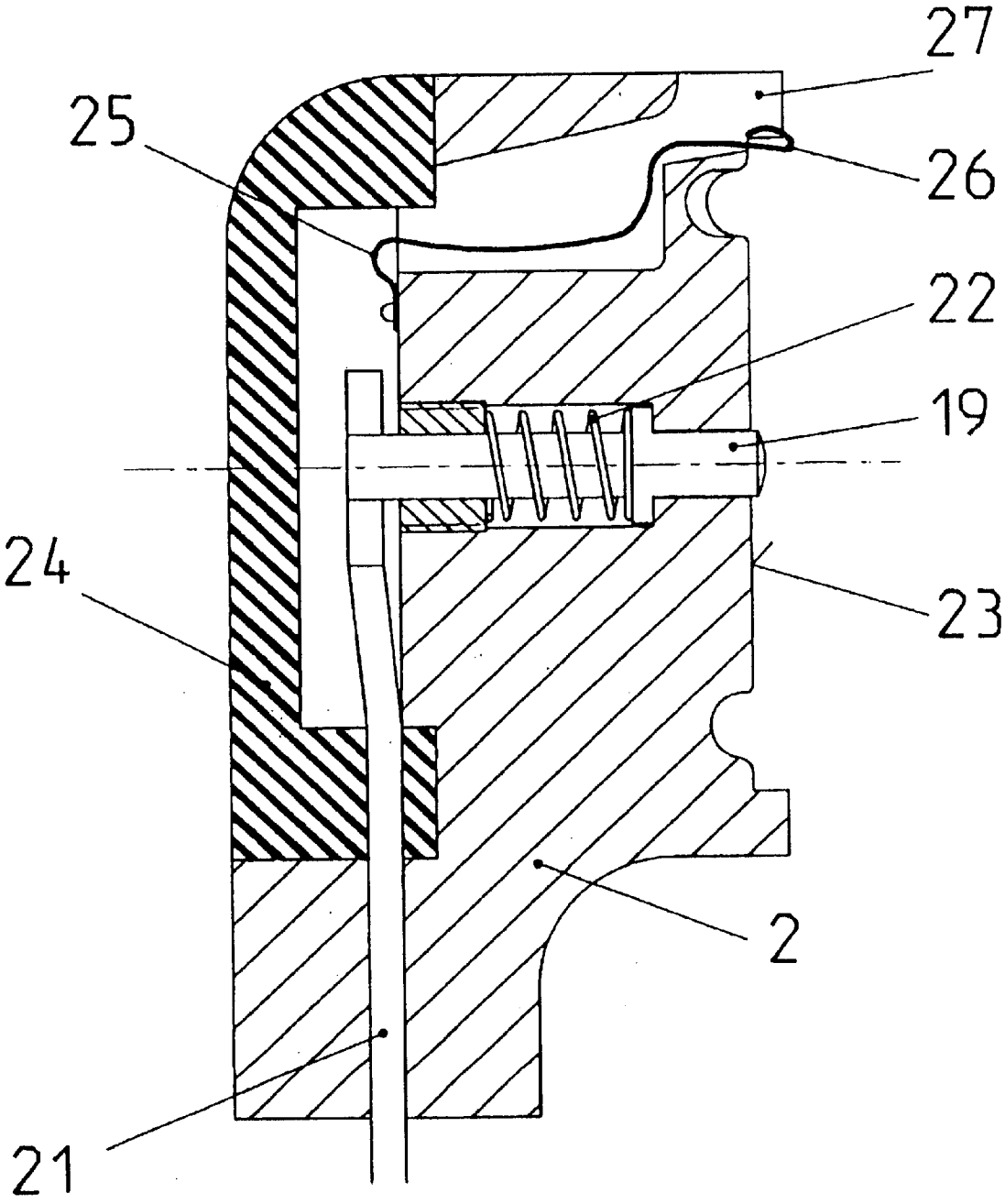
Figure 6:
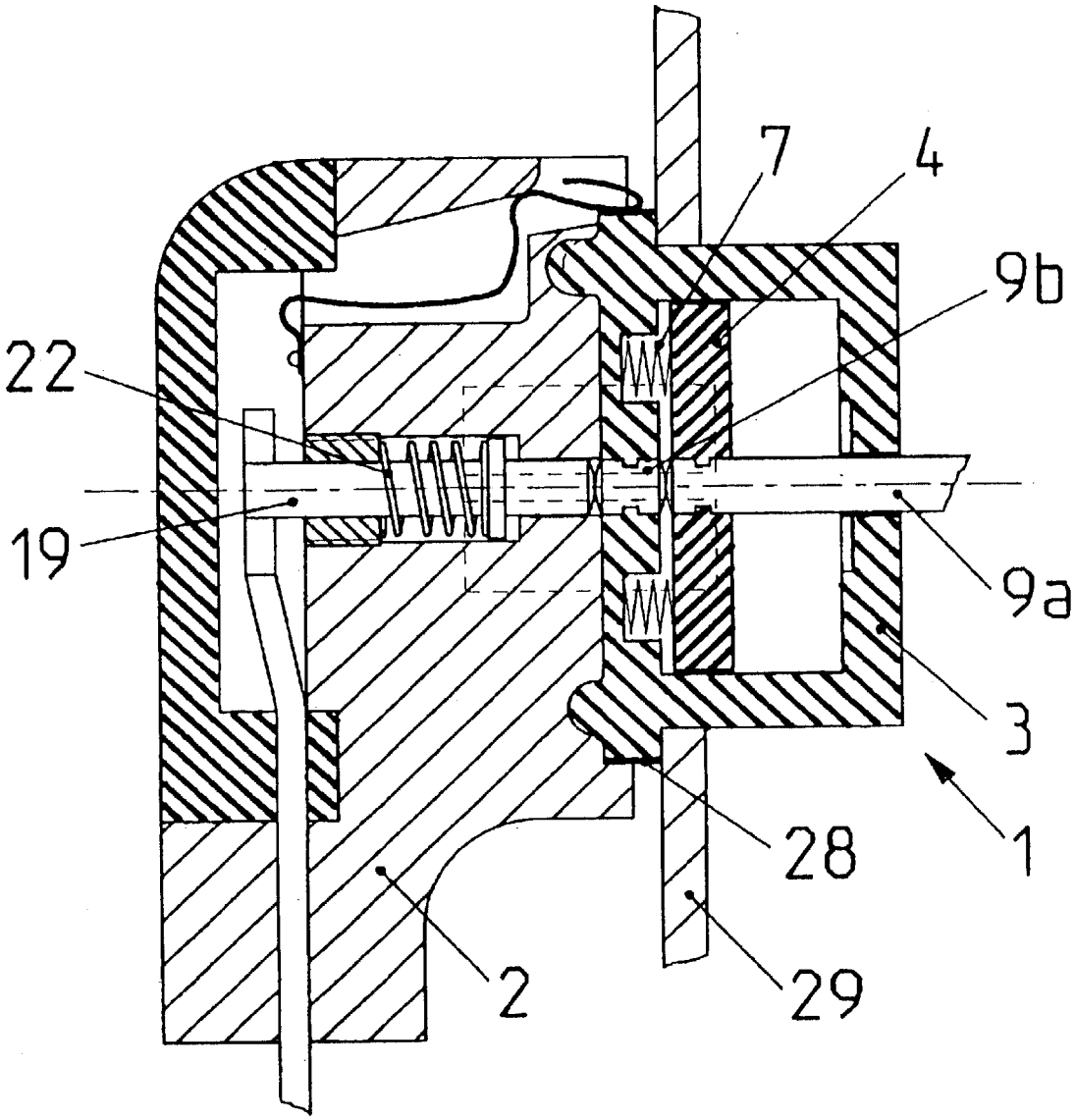

Advantageous developments and configurations follow from the remaining subclaims and from the exemplary embodiment described in principle below with the aid of the drawing, in which:

FIG. 1 shows an enlarged representation of an inventive switching mechanism, in top view, FIG. 2 shows a section along the line II—II in FIG. 1, FIG. 3 shows a section along the line III—III in FIG. 1, FIG. 4 shows an enlarged representation of a top view of the tripping mechanism, FIG. 5 shows a section along the line V—V in FIG. 4, and FIG. 6 shows a switching mechanism and tripping mechanism in section in a state in which they are connected and carrying current.

DETAILED DESCRIPTION OF THE INVENTION

Two coaxial contact parts 8*a* and 8*b* for the positive pole and, contact parts 9*a* and 9*b* for the negative pole are provided in each case as contact elements in the switching mechanism 1. The contact parts 8*a* and 9*a* are arranged on the operating slide 4 or connected thereto, and simultaneously also make the respective contact wiht the supply leads to the switching mechanism 1. The contact parts 8*b* and 9*b* are located in the end face 10, directed toward the tripping mechanism, or the switching mechanism 1. However, they are separated from the coded magnet parts 5*a*–5*d*.

The embodiment represented is suitable, in particular, for the low-voltage range, for example 12 volts, and for direct current. Of course, however, it is also suitable in principle for higher voltages and also for alternating current.

With reference to their design principle and to the fact that they are switched via coded magnets, the switching mechanism 1 and the tripping mechanism 2 are designed in a similar way to the device described in EP 0 573 471 B1.

Thus, the switching mechanism 1 has a closed assembly with a housing 3. In the state of rest, that is to say when the tripping mechanism 2 is not mounted on the switching mechanism 1, an operating slide 4 on which actuating magnets 5 in the form of coded magnet parts 5*a*–5*d* are arranged is held on the base of the housing 3 by a ferromagnetic retaining plate 6.

As may be seen, in particular, from FIG. 1, the coded magnet parts 5*a*–5*d* are arranged in the central or inner region of the switching mechanism 1 in such a way that north and south poles adjoin one another in each case on the side directed toward the tripping mechanism 2. This provides a coded actuating magnet 5 with two north poles and two south poles in a specific arrangement which cooperate only in the sense of an attractive force with magnet parts which are of correspondingly opposite polarity.

Together with the ferromagnetic retaining plate 6, resetting springs 7 ensure resetting of the operating slide 4 after separation of the tripping mechanism 2 from the switching mechanism 1.

Two coaxially sequential contact parts 8*a* and 8*b* for the positive pole and, contact parts 9*a* and 9*b* for the negative pole are provided in each case as contact elements in the switching mechanism 1. The contact parts 8*a* and 9*a* are arranged on the operating slide 4 or connected thereto, and simultaneously also make the respective contact with the supply leads to the switching mechanism 1. The contact parts 8*b* and 9*b* are located in the end face 10, directed toward the switching mechanism, of the switching mechanism 1. However, they are separated from the coded magnet parts 5*a*–5*d*.

Located in the outer circumferential region on the end face 10, facing the tripping mechanism, of the switching mechanism 1 is a projection which can be constructed as a partial annular bead 11. In this case, the partial annular bead 11 extends over 330 degrees, for example. This means that there remains a corresponding free space 12 of approximately 30 degrees. Located diametrically opposite the free space 12 in the partial annular bead 11 is an elevation 13 which likewise extends over an angular range of approximately 30 degrees.

The tripping mechanism 2 represented in FIGS. 4 and 5 is provided in the same circumferential region with a depression which is complementary or adapted to the partial annular bead 11 and can be constructed as a partial annular groove 14. Just like the partial annular bead 11, the partial annular groove 14 extends over a range of approximately 330 degrees. Likewise present is a free space 15 with a width, again, of approximately 30 degrees. Located opposite the free space 15 in the partial annular groove 14 is a deeper trough 16 which likewise extends over an angular range of approximately 30 degrees.

The tripping mechanism 2 also has coded tripping magnets 17 with tripping magnet parts 17*a* to 17*d*. The polarities of the tripping magnet parts 17*a* to 17*d* are selected such that when the tripping mechanism is mounted on the switching mechanism (see FIG. 6) north and south poles are respectively situated opposite one another so that an appropriate attractive force is exerted on the operating slide 4. Contact elements 18 and 19 separated from the tripping magnet parts 17*a*–17*d* are likewise provided for introducing current into the tripping mechanism 2 so that a consumer (not represented) can be supplied appropriately with current or voltage.

This purpose is served by cables 20 and 21 connected to the contact elements 18 and 19.

As may be seen from FIG. 5, the contact elements 18 and 19 are configured under the pretensioning of a spring device 22 in such a way that the correspondingly spring-mounted contact elements 18 and 19 project slightly from the end face 23, directed toward the switching mechanism 1, of the tripping mechanism 2.

A good current contact is created in this way when the switching mechanism 1 is connected to the tripping mechanism 2.

For reasons of assembly, the tripping mechanism 2 is provided in two parts with a cover 24 on the side averted from the end face 23. When the cover 24 is removed, it is possible to access the cables 20 and 21 and the contact elements 18 and 19, and likewise the tripping magnets 17. This also provides the fastening of an earthing spring 25 whose front end projects in the form of a loop 26 in a resilient fashion beyond the front end face 23 in the region of a centering nose 27 of the tripping mechanism 2. One or more earthing springs 25 arranged along the circumferential wall of the tripping mechanism cooperates in this way in the case of coupling of the switching mechanism 1 and the tripping mechanism 2 with an earthing ring 28 of the switching mechanism 1 (see FIG. 6).

FIG. 6 shows the switching mechanism 1 and the tripping mechanism 2 in the mutually connected state, current being transmitted from a current source (not represented) via the contact parts 8*a*, 8*b* and 9*a*, 9*b* onto the contact elements 18 and 19. As soon as the tripping mechanism 2 is mounted on the switching mechanism 1, the operating slide 4 is raised out of its rest position from the ferromagnetic retaining plate 6 by the magnetic force of the coded magnets 5 and 17.

Because of the partial annular bead 11 with its elevation 13, the tripping mechanism 2 can in this case be placed on the switching mechanism 1 only in a fashion so accurate to fit that the elevation 13 comes to lie in the deepened trough 16 of the partial annular groove 14. This ensures that it is always only the two positive poles and the two negative poles of the contact parts 8 and 9 which come to one another.

In this way, the current is transmitted from the contact parts 8*a* and 9*a*, which are connected to the power supply, onto the contact parts 8*b* and 9*b*, and thus onto the contact elements 18 and 19 of the tripping mechanism 2. This position is to be seen in FIG. 3, while FIG. 2 shows the operating slide 4 in the rest position. The earthing ring 28 is connected to an earthing line (not represented), thus providing the cooperation with the earthing spring 25, and thus additional safety against short circuiting or other instances of malconduction of current.

In order to separate the tripping mechanism 2 from the switching mechanism 1, which is installed in any desired position in a part surrounding the switching mechanism 1, for example a dashboard 29, all that is required is to disengage the tripping mechanism 2 from the switching mechanism 1 through a slight rotation. In this case, the interruption of current is facilitated by the partial annular bead 11 with its elevation 13 in cooperation with the partial annular groove 14 and the trough 16. As is to be seen from FIG. 6, specifically, in the switched state the elevation 13 of the switching mechanism 1 is situated in the trough 16 of the tripping mechanism 2. The remaining region of the partial annular bead 11 is situated in the partial annular groove 14. The two free spaces 12 and 15 are likewise situated one above another.

If the tripping mechanism 2 is now rotated appropriately, the elevation 13 "rises" out of the trough 16 and at the same time a part of the partial annular bead 11 likewise passes out of the partial annular groove 14 into the region of the free space 15. This means that during the rotation a spacing is necessarily created between the end face 10 of the switching mechanism and the end face 23 of the tripping mechanism 2, the coded tripping magnets 17 distancing themselves from the actuating magnets 5 in such a way that the operating slide 4 cooperates with the resetting springs 7 to return into its rest position on the ferromagnetic plate 6. This provides quick and reliable separation of the contact elements, and thus interruption of the current to the tripping mechanism 2 and thus to the consumer. The formation of sparks is avoided in this way.

Numerous applications are possible for the electromechanical connecting device according to the invention. Computer engineering may be mentioned here purely by way of example. A further field of application is motor vehicles, it being possible for the switching mechanism 1 to be installed in the dashboard 29, for example. As may be seen, the switching mechanism projects only slightly above the front of the dashboard, and the overall depth is also very shallow.

Further fields of application are, for example, consumer electronics such as, for example, video equipment and hi-fi towers with their controls. It is also possible for other controlling and monitoring devices to be provided with the electromechanical connecting device according to the invention.

What is claimed is:

1. An electromechanical connecting device having a switching mechanism which can be connected via power supply contacts to a current source, an operating slide including coded magnet parts, a housing enclosing the operating slide in a closed assembly, the switching mechanism connected to a tripping mechanism which includes tripping magnets having additional coded magnet parts, the tripping and switching mechanisms including contact elements adapted to be connected electrically to a consumer, whereby connecting the two mechanisms in axial alignment brings the switching magnets from a rest position into a working position against a retaining force and completing the electrical connection between the switching mechanism and the tripping mechanism through contact elements disposed in the switching mechanism and the tripping mechanism, the switching mechanism and the tripping mechanism each being provided on mutually facing end faces with corresponding centering elements, the switching mechanism and the tripping mechanism toward the switching mechanism, the electical connection between the switching mechanism and the tripping mechanism made in only a specific position of the coded magnet parts and additional coded magnet parts relative to each other; one of the mechanisms including at least one projection, the at least one projection including an elevation which rises above the projection and is adapted to mate with a correspondingly positioned through in the end face of the other mechanism;

the projection constructed as a bulging partial annular bead disposed on one of the end faces and, when the electrical connection is made, is situated in a partial annular groove disposed on the end face of the other mechanism, and which groove corresponds in shape and position to receive the bulging partial annular bead.

2. An electromechanical connecting device according to claim 1, adapted to carry electrical current in a DC low-voltage range.

3. An electromechanical connecting device according to claim 1, wherein the at least one projection includes an elevation which rises above the projection and is adapted to mate with a correspondingly positioned trough in the end face of the other mechanism.

4. An electromechanical connecting device according to claim 1, wherein the partial annular bead is provided with an elevation, and a trough formed in the partial annular groove.

5. An electromechanical connecting device according to claim 1, wherein the coded magnets and additional coded magnets comprise a plurality of magnet parts with different polarities arranged respectively in a central region of the switching mechanism and in a central region of the tripping mechanism.

6. An electromechanical connecting device according to claim 1 wherein the contact elements of the tripping mechanism are pretensioned by spring devices in the direction of an electrical connection with the switching mechanism.

7. An electromechanical connecting device according to claim 1, wherein the contact parts in the switching mechanism each include two coaxially sequential contact parts for each of a positive pole and a negative pole, wherein one element of one contact part is connected to the power supply and is disposed on the operating slide, and a second element of another contact part is disposed on the end face directed toward the tripping mechanism.

8. An electromechanical connecting device according to claim 1, wherein the tripping mechanism is connected at its circumference to at least one earthing spring which projects beyond the end face directed toward the switching mechanism, and which earthing spring is adapted to contact and earthing ring in the switching mechanism.

9. An electromechanical connecting device according the claim 1, wherein the contact elements are separated from the coded magnets and additional coded magnets.

10. An electromechanical connecting device having a switching mechanism which can be connected via power supply contacts to a current source, an operating slide including coded magnet parts, a housing enclosing the operating slide in a closed assembly, the switching mechanism releasably connected to a tripping mechanism which includes tripping magnets having additional coded magnet parts, the tripping and switching mechanisms including contact elements adapted to be connected electrically to a consumer, whereby connecting the two mechanisms in axial alignment brings the switching magnets from a rest position into a working position against a retaining force and completing the electrical connection between the switching mechanism and the tripping mechanism through the contact elements disposed in the switching mechanism and tripping mechanism, the switching mechanism and the tripping mechanism each being provided on mutually facing end faces with corresponding centering elements, the electrical between the switching mechanism and the tripping mechanism made in only a specific position of the coded magnet parts and additional coded magnet parts relative to each other, centering elements having at least one projection disposed in an end face of one of the switching mechanism, and at least one depression corresponding to the at least one projection in an end face of the other mechanism; one of the mechanisms including at least one projection, the at least one projection including an elevation which rises above the projection and is adapted to mate with a correspondingly positioned trough in the end face of the other mechanism; the projection constructed as a bulging a partial annular bead disposed on one of the end faces and, when the electrical connection is made, is situated in a particular annular groove on the end face of the other mechanism, and which groove corresponds in shape and position to receive the bulging partial annular bead.

* * * * *

UNITED STATES PATENT AND TRADEMARK OFFICE

CERTIFICATE OF CORRECTION

PATENT NO. : 6,966,781 B1 
DATED : November 22, 2005
INVENTOR(S) : Achim Bullinger, Klaus-Dieter Fritsch and Hermann Neidlein It is certified that error appears in the above-identified patent and that said Letters Patent is hereby corrected as shown below:

Title page,
Item [73], Assignee, add -- Klaus-Dieter Fritsch of Heidenheim (DE) --.

Signed and Sealed this

Twenty-first Day of March, 2006

JON W. DUDAS
*Director of the United States Patent and Trademark Office*